US005904080A

United States Patent [19]

Anderson et al.

[11] Patent Number: 5,904,080

[45] Date of Patent: May 18, 1999

[54] 8 IN 1 TOOL BIT DRIVER HAND TOOL

[76] Inventors: Wayne Anderson, 65 Grove St.; Paolo Cassutti, 8 N. Creek Rd., both of Northport, N.Y. 11768

[21] Appl. No.: 08/977,453

[22] Filed: Nov. 24, 1997

Related U.S. Application Data

[63] Continuation of application No. 08/620,471, Mar. 22, 1996, abandoned.

[51] Int. Cl.[6] ..... B25B 23/00

[52] U.S. Cl. ..... 81/439; 81/438; 81/177.4

[58] Field of Search ..... 81/437–439, 177.4, 81/490, 177.85

[56] References Cited

U.S. PATENT DOCUMENTS

| | | | |
|---|---|---|---|
| 2,596,594 | 5/1952 | Petre | 81/439 X |
| 2,641,478 | 6/1953 | Sigg | 81/439 X |
| 3,114,401 | 12/1963 | Johnson | 81/438 |
| 4,448,097 | 5/1984 | Rocca | 81/439 X |
| 5,450,775 | 9/1995 | Kozak | 81/440 |
| 5,533,429 | 7/1996 | Kozak | 81/438 X |

FOREIGN PATENT DOCUMENTS

| | | | |
|---|---|---|---|
| 403769 | 1/1934 | United Kingdom | 81/439 |

*Primary Examiner*—D. S. Meislin
*Attorney, Agent, or Firm*—Lackenbach Siegel Marzullo Aronson & Greenspan

[57] ABSTRACT

A hand tool for torquing a fastener by means of at least one hexagonal cavity in an outer reversible coupling member, and a pair of inner, hexagonal shaped, reversible coupling members having differently sized hexagonal cavities than that of said at least one hexagonal cavity of said outer reversible coupling member. The inner, hexagonal shaped reversible coupling members being removably retained in the at least one hexagonal cavity of said outer coupling member, and a handle having cavity means of a size and shape for removably retaining the outer reversible coupling member, and for driving another differently sized hexagonal fastener; whereby the hand tool is capable of driving differently sized hexagonal fasteners depending upon at least the hexagonal cavities of the outer reversible coupling member and the inner, hexagonal shaped reversible coupling members.

5 Claims, 5 Drawing Sheets

8 IN 1 TOOL BIT DRIVER HAND TOOL

This application is a continuation of application Ser. No. 08/620,471, filed Mar. 22, 1996, now abandoned.

BACKGROUND OF THE INVENTION

This invention relates to hand tools; and, more particularly, it relates to multiple bit hand tools that provide variable reach and that function as many different hand tools while only utilizing the space of about a single hand tool. When purchasing a set of hand tools, professional tradesmen and do-it-yourselfers are frequently required to purchase several of a series of hand tools that have different length shank portions and different type driving ends, e.g. Phillips®, Torx®, flat head, etc. The combinations of different tools needed to complete a set of hand tools having various different driving ends and of various different shank lengths increases the cost associated with having a complete set since each tool is generally sold seperately. Moreover, there is a significant draw-back for a user of a plurality of different tools in that the user must carry with him a specific tool for each task he wishes to accomplish. For example, a user may need to bring with him a number two Phillips screw driver with a two inch shank, a number one Phillips screw driver with a six inch shank, a number three Phillips screw driver with a four inch shank to accomplish a single task. As a consequence the user's tool belt or tool box soon becomes cluttered with these hand tools there results a concomitant increase in the weight of tools the user must carry from one location to another.

Furthermore, boat owners, sports utility vehicle owners, summer home owners have a need for single multi-purpose, variable shank length tool that they can store on a respective vehicle or home in the event an emergency arises.

All of these developments have created a need for a single hand tool that has a variety of functions and serves as multiple hand tools. However, this need has not been easily achieved. Traditional hand tools do not provide for variable length shanks that can be utilized with a variety of different driver bits. Hence, there exists a need for a single hand tool and kit that functions as a mulitplicity of tools that can store, organize and retain a large number of desired tool accessories including driver bits, and that functions as a multiplicity of different tools while displacing no more volume than a conventional single purpose hand tool.

There are numerous tools in the art that fail to meet these market needs and that suffer from a number of drawbacks. In particular, attention is drawn to: U.S. Pat. No. 686,424 to Smith; U.S. Pat. No. 3,114,401 to Johnson et al.; U.S. Pat. No. 4,448,097 to Rocca et al.; and, U.S. Pat. No. 5,450,775 to Kozak. All of these references suffer from the draw back of having a single fixed reach.

Other patents of general interest include U.S. Pat. No. 19,901 to Aiken, U.S. Pat. No. 438,150 to Glover, U.S. Pat. No. 463,507 to Goodell, U.S. Pat. No. 2,158,728 to Peters, U.S. Pat. No. 2,476,762 to Petre et al., U.S. Pat. No. 2,527,492 to Cleary et al., U.S. Pat. No. 2,596,594 to Petre et al., U.S. Pat. No. 2,635,661 to Egan et al., U.S. Pat. No. 2,759,734 to Velepec et al., U.S. Pat. No. 3,426,813 to Robertson, U.S. Pat. No. 3,455,355 to McLogan et al., U.S. Pat. No. 4,043,230 to Scrivens et al., U.S. Pat. No. 4,278,119 to Elmore et al., U.S. Pat. No. 4,404,874 to Lieser et al., U.S. Pat. No. 4,552,043 to Corona et al., U.S. Pat. No. 4,776,246 to Elliston, U.S. Pat. No. 4,779,493 to White, U.S. Pat. No. 4,846,042 to Wetty, U.S. Pat. No. 4,924,733 to McKenzie, U.S. Pat. No. 5,174,178 to Disston, U.S. Pat. No. 5,228,363 to Corona et al., U.S. Pat. No. 5,265,504 to Fruhm, U.S. Pat. No. 5,325,745 to Koehler, and U.S. Pat. No. 5,337,637 to Bih-Lien. All of these tools have the drawbacks of a single reach or lack of ability to utilize dual driver bits.

It is an object of the present invention to solve the variety of problems that exist in the art and to satisfy these market needs.

SUMMARY OF THE INVENTION

The objects and features of the present invention, other than those specifically set forth above, will become apparent in the detailed description of the invention set forth below.

DETAILED DESCRIPTION OF THE INVENTION

Figure 1:
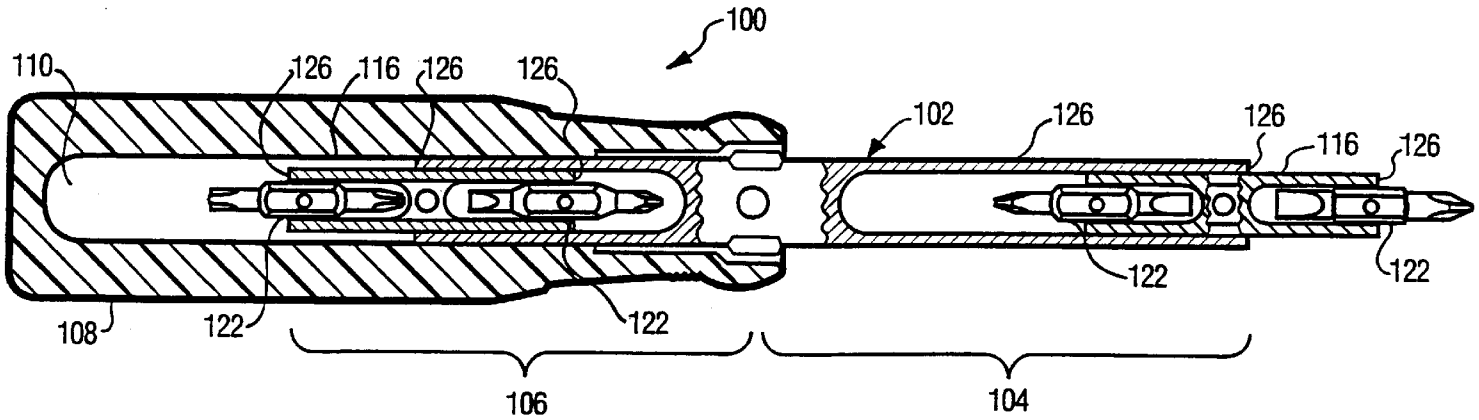
FIG. 1 is a side cross sectional view of a variable reach multi-bit driver hand tool with the hand tool in a long reach mode.
Figure 2:
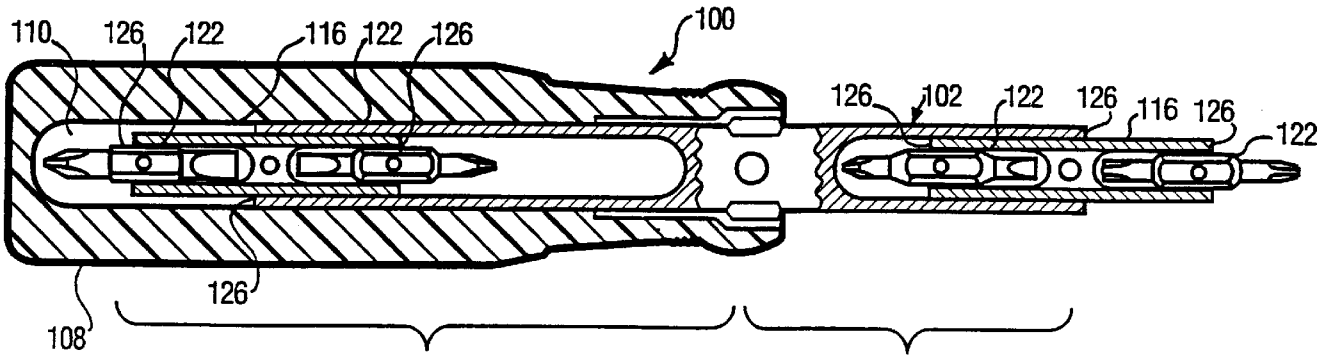
FIG. 2 is a side cross sectional view of the variable reach multi-bit driver hand tool of FIG. 1 in short reach mode.
Figure 6:
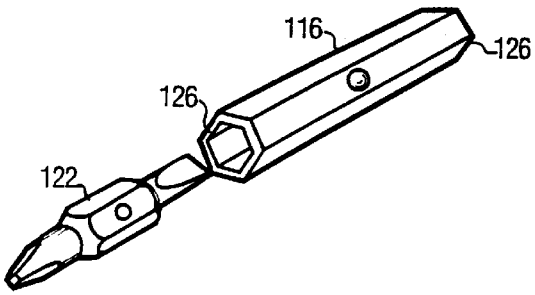
FIG. 6 is a perspective view a servant hexagonal coupling and driver bit of FIGS. 1 and 2.
Figure 3:
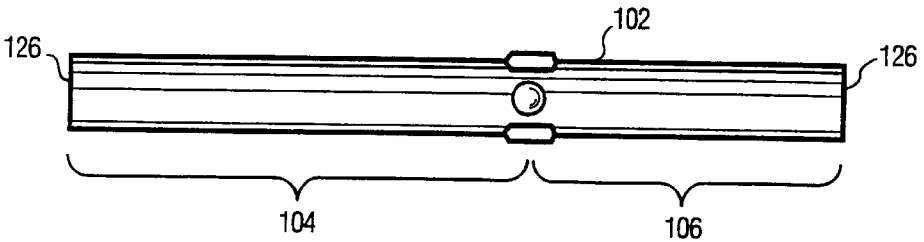
FIG. 3 is a side view of a variable reach master coupling of the hand tool of FIG. 1.
Figure 11:
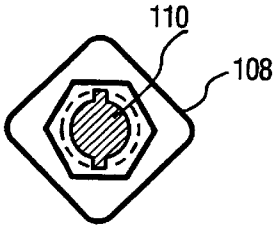
FIG. 11 is a bottom plan view of the hand tool of FIG. 1.
Figure 8:
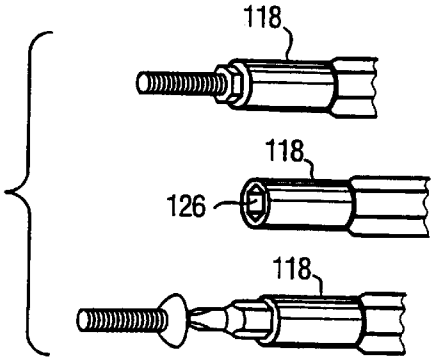
FIG. 8 is a partial perspective view of servant couplings which serve as nut drivers.

FIG. 1 is a side cross sectional view of a variable reach multi-bit driver hand tool 100 with hand tool 100 in a long reach mode, and FIG. 2 is a side cross sectional view of the variable reach multi-bit driver hand tool 100 of FIG. 1 in short reach mode. Hand tool 100 having a handle 108 (FIGS. 1, 2, 7, 9–11) includes a variable reach reversible coupling member 102 (FIGS. 1–3) having a long reach portion 104 (FIGS. 1–3) and a short reach portion 106 (FIGS. 1–3) thereon. Handle 108 (FIGS. 1–2) has inner cavity 110 (FIGS. 1, 2 and 11) of a size and shape for removeably retaining reversible coupling member 102. Inner cavity 110 is generally of a depth within handle 108 to accomodate and enclose long reach portion 104 and short reach portion 106 within the interior on the handle.

Figure 4:
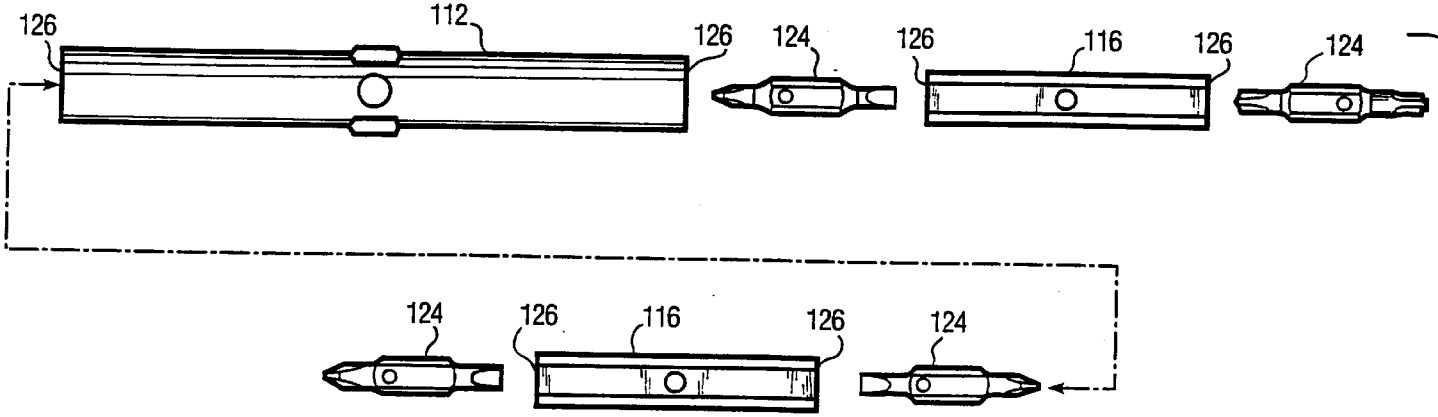
FIG. 4 is an exploded side view of a reversible master coupling, servant couplings, and dual reach driver bits.
Figure 5:
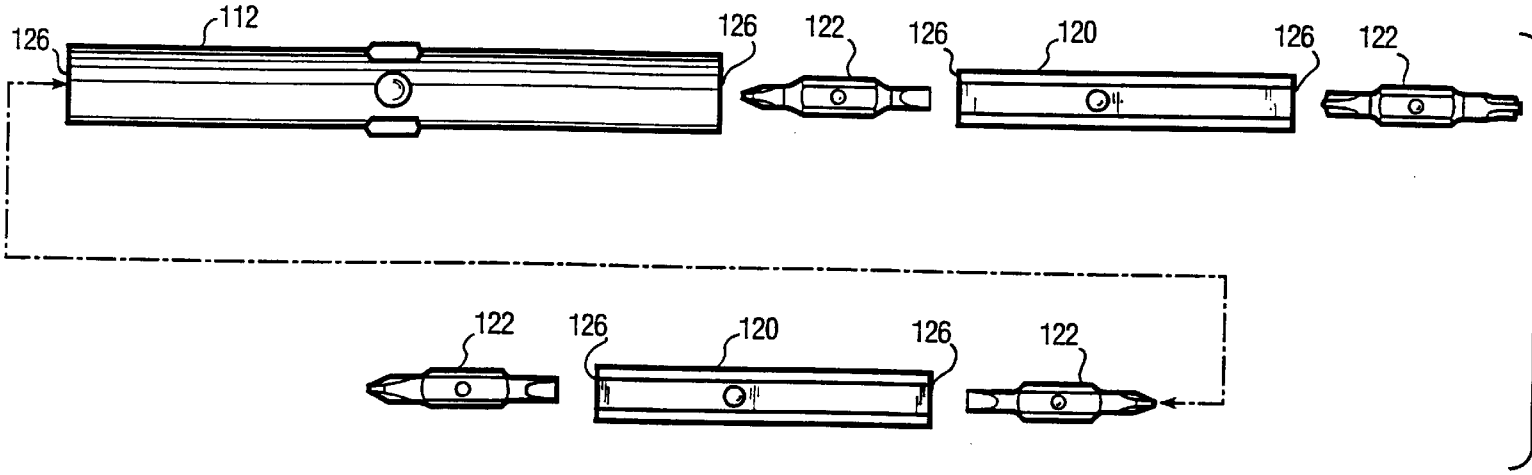
FIG. 5 is an exploded side view of a reversible master coupling, dual reach servant couplings, and driver bits.

Generally, variable reach reversible coupling member 102 (FIGS. 1–3) and symmetric reversible master coupling member 112 (FIGS. 4 and 5), 114 (FIGS. 7, 9 and 10) include at least one symetric bit retaining coupling 116 (FIGS. 1, 2, 4, 6), 118 (FIGS. 7–10). Reversible coupling members 102, 112 include a plurality of nested bit retaining couplings 116, asymetrical or variable length bit retaining couplings 120 (FIG. 5), or a combination thereof. Bit retaining couplings 116, 120 further include mateable symetric driver bits 122 (FIGS. 1, 2, 5–7 and 9), and/or asymetric driver bits 124 (FIG. 4). Bits 122, 124 can be either single drive portion driver bits or dual drive portion driver bits having driving ends on opposite sides of the bits as illustrated in the Figures. Thus, the reversible master coupling member may be of the symmetrical or asymmetrical type, and the servant or inner reversible coupling member may be of the symmetrical or asymmetrical type. In a like manner, the bits themselves or bit drivers may likewise be of symmetrical length or asymmetrical length.

As illustrated in FIGS. 1, 2, 4, 7, and 9, hand tool 100 has reversible coupling members 102, 112 that include first bit retaining coupling 102, 112, and second bit retaining coupling 102, 112 so that each bit retaining coupling 102, 112 has a pair of removable driver bits 122, 124 thereon.

It is appreciated that the interior of variable master bit retaining couplings 102, 114, variable or asymetric bit retaining couplings 120, symetric bit retaining couplings 116, 118 have hexagonally (square, pentagonally, heptagonally, octagonally, etc.) shaped inner portions 126 that serve as a nut driver. The couplings 102, 114, 116, and 118 optionally have at opposite ends thereof hexagonally shaped inner portions 126 (FIGS. 1–10). By varying the driver bit 122, 124 size, e.g. 3/16", 7/32", 1/4"; 9/32', 5/16" and 3/8" and hexagonal inner portions 126, hand tool 100 becomes a multi-function tool that include eight screwdrivers as well as five nut drivers. This results in hand tool 100 functioning as at least thirteen different tools in one tool.

Figure 7:
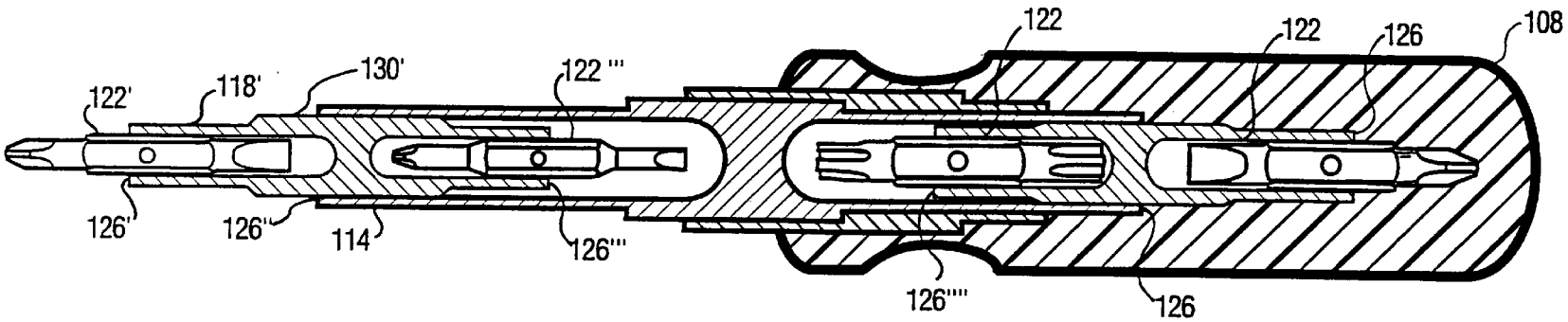
FIG. 7 is a side cross sectional view of a variant of the hand tool of FIG. 1 having a hexagonal drive portion.
Figure 10:
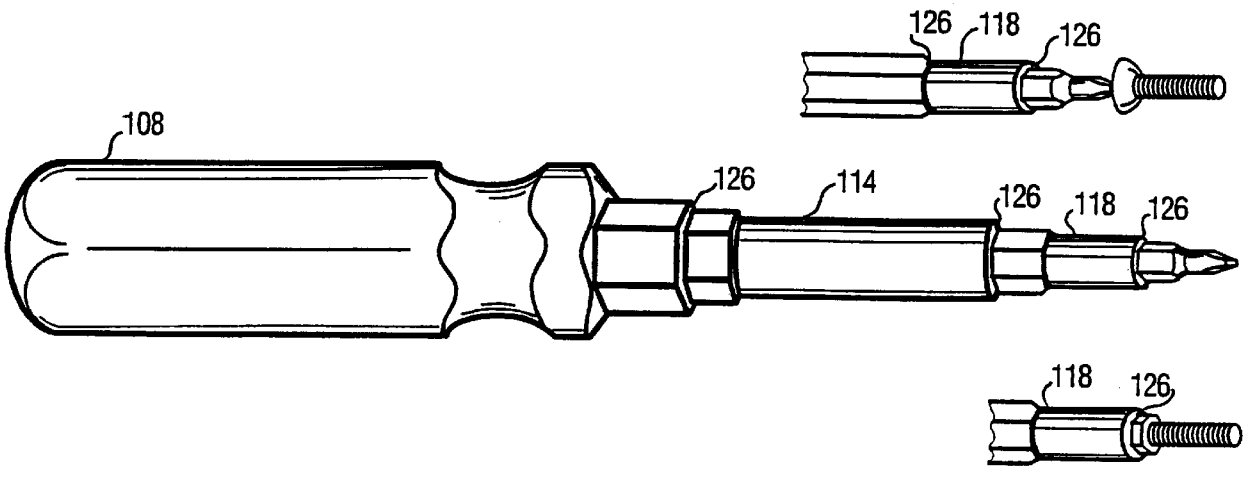
FIG. 10 is a perspective view of the hand tool of FIG. 7.
Figure 9:
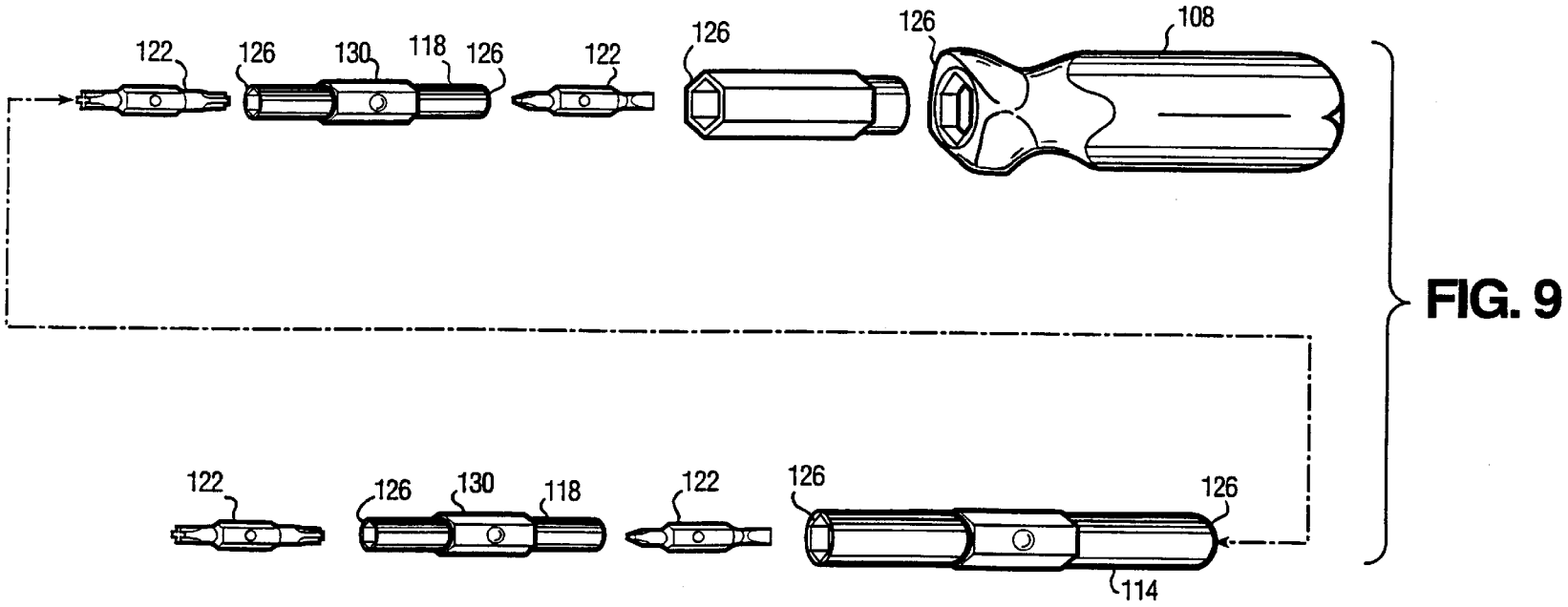
FIG. 9 is an exploded perspective view of the hand tool of FIG. 7.

Hexagonal inner portions 126 include the two most popular nut drivers that of 1/4" and 5/16". Where hand tool 100 includes both of these nut driver dimensions, hand tool 100 includes eight screwdrivers and two nut drivers. Preferably, as illustrated in FIG. 7, hexagonal inner portion 126' (analogous to 126) serves as a 7/32" nut driver and the exterior hexagonal dimension of driver bit 122' is of a size and shape to readily mate with a 7/32" nut driver portion of coupling member 118'. Hexagonal inner portion 126" is of a size and shape of a 5/16" nut driver and hexagonal portion 130' is complementary thereto. Hexagonal inner portion 126"' is of a size and shape of a 3/16" nut driver and driver bit 122"' is complementary thereto. Hexagonal inner portion 126"" is of a size and shape of a 5/16", 9/32", 3/8", or 1/4" nut driver and driver bits 122 mating thereto are complementary thereto, respectively. Preferably, hand tool 100 includes hexagonal inner portions 126', 126", 126"' and 126"" that include 3/16", 1/4", and 5/16" nut driver portions that include variable reach couplings 102, 112, 116, and 120.

With the hand tool of the present invention, it will be appreciated that by simply varying the bit driver size, one can achieve multiple drivers, for example, seven (7) different nut drivers as well as eight (8) screwdriver bits. With bits and, for example, polygonal apertures, such as hexagons in the "hollow" coupling members, with each being of different size, one has the ability to drive different size nuts and/or screws. As an example (see FIG. 9), beginning with coupling 130, it may have both 3/16 and 1/4 inch sizes with coupling 114 having 5/16 and 7/16 inch sizes, and coupling 118 having 5/16 and 3/8 inch size with element 126 being of 9/18 inch in size.

As another example of the invention hand tool, best shown in FIG. 4, coupling 116 may comprise a 5/16 inch hex shaft with 1/4" ND at both ends, and with coupling 112 having 5/16" ND at both ends; with bit 124 being a 1/4" hex, and with coupling 116 comprising a 5/16" hex shaft having 1/4" ND at both ends thereof. With this example, the bit on each end is of the same size (per intermediate tube or coupling). Thus, one has only two (2) nut driver sizes. Removing the bit provides one with a 1/4" nut driver and removing the intermediate tube or shaft coupling provides a 5/16" nut driver. This construction is more economical to make as compared to the above initial example, and thus would have greater marketability.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A combination hand tool consisting essentially of:

a handle being formed with an inner cavity;

first means comprising unitary one-piece construction comprising first wall means and being formed with oppositely disposed separate first means inner cavities separated by said first wall means, each said first means inner cavity comprising means for retaining tool bit driver means and for driving nut means;

second means comprising unitary one-piece construction comprising second wall means and being formed with oppositely disposed separate second means inner cavities separated by said second wall means, each said second means inner cavity comprising means for retaining tool bit driver means and for driving nut means;

third means comprising unitary one-piece construction comprising third wall means and being formed with oppositely disposed separate third means inner cavities separated by said third wall means, said first, second and third means comprising means for slidably retaining said first and second means in said third means inner cavities, and each said third means cavity further comprising means for driving nut means, said third means being sized to be slidably disposed in said handle cavity;

4 tool bit driver means, each said tool bit driver means comprising oppositely disposed tool bit drivers so as to comprise 8 tool bit drivers, and further comprising a coupling body portion between 2 tool bit drivers, and each said tool bit driver means being sized to be slidably retained in one of said first and second means inner cavities;

said third means unitary construction having oppositely disposed ends, and being formed with a cylindrical outer surface extending from one end to the other, and being formed with hexagonal inner surfaces comprising said inner cavities, and wherein said inner hexagonal surfaces juxtaposed at respective opposite disposed ends comprise said means for driving nut means, said handle cavity comprising cylindrical inner cavity and recessed wall, said third means cylindrical outer surface being formed with means for limiting the disposition of the third means in the handle cavity, whereby with the third means disposed in the handle, the one third means end disposed within the handle is spacedly disposed from the recessed wall, wherein 4 tool bit drivers and 3 nut means drives are disposed in the handle and 4 tool bit drivers and 3 nut means drivers are disposed outside the handle.

2. The hand tool of claim 1, said first, second and third means further comprising at least two different nut means drivers.

3. The hand tool of claim 1, each said means for retaining tool bit driver means and each said coupling body portion being hexagonal.

4. A combination hand tool comprising:

a handle being formed with an inner cavity;

first means for housing tool bit drive means, said first means comprising unitary one-piece construction, said first means comprising first wall means for forming oppositely disposed separate first means inner cavities separated by said first wall means, each said first means inner cavity comprising means for retaining said tool bit drive means and for driving nut means;

second means for housing tool bit drive means, said second means comprising unitary one-piece construction, said second means comprising second wall means for forming oppositely disposed separate second means inner cavities separated by said second wall means, each said second means inner cavity comprising means for retaining said tool bit drive means and for driving nut means;

third means for housing tool bit drive means, said third means comprising unitary one-piece construction, said third means comprising third wall means for forming oppositely disposed separate third means inner cavities separated by said third wall means, said first, second and third means comprising cooperative means for slidably retaining said first and second means in said third means inner cavities, and each said third means inner cavity further comprising means for driving nut means, said third means being sized to be slidably disposed in said handle cavity; and 4 tool bit driver means, each said tool bit driver means comprising oppositely disposed tool bit drivers so as to comprise 8 tool bit drivers, and further comprising a coupling body portion between 2 tool bit drivers, and each said tool bit driver means being sized to be slidably retained in one of said first and second means inner cavities;

said third means unitary construction having oppositely disposed ends, and being formed with a cylindrical outer surface extending from one end to the other, and being formed with hexagonal inner surfaces comprising said inner cavities, and wherein said inner hexagonal surfaces juxtaposed at respective opposite disposed ends comprise said means for driving nut means, said handle cavity comprising cylindrical inner cavity and recessed wall, said third means cylindrical outer surface being formed with means for limiting the disposition of the third means in the handle cavity, whereby with the third means disposed in the handle, the one third means end disposed within the handle is spacedly disposed from the recessed wall, wherein 4 tool bit drivers and 3 nut means drivers are disposed in the handle and 4 tool bit drivers and 3 nut means drivers are disposed outside the handle;

whereby said 8 tool bit drivers are operably retained in said first, second and third means unitary one-piece constructions.

5. The combination hand tool of claim 4, said first and second means being interchangeable in said third means inner cavities.

* * * * *